United States Patent [19]

Suga et al.

[11] 4,279,540

[45] Jul. 21, 1981

[54] COLLAPSABLE DAM

[75] Inventors: Kyozo Suga, Tokyo; Jinya Iizuka; Yoshiomi Tsuji, both of Osaka, all of Japan

[73] Assignees: Kazuto Nakazawa, General Director Public Works Research Institute Ministry of Construction, Tokyo; Sumitomo Electric Industries, Ltd., Osaka, both of Japan

[21] Appl. No.: 10,773

[22] Filed: Feb. 9, 1979

[51] Int. Cl.[3] ..... E02B 7/04

[52] U.S. Cl. ..... 405/115; 405/91

[58] Field of Search ..... 405/115, 90, 107, 87–89, 405/91, 80

[56] References Cited

U.S. PATENT DOCUMENTS

| | | | |
|---|---|---|---|
| 495,788 | 4/1893 | Debarle | 405/115 |
| 3,834,167 | 9/1974 | Tabor | 405/115 |

FOREIGN PATENT DOCUMENTS

| | | | |
|---|---|---|---|
| 6506682 | 6/1965 | Netherlands | 405/115 |

*Primary Examiner*—Dennis L. Taylor

*Attorney, Agent, or Firm*—Sughrue, Mion, Zinn, Macpeak and Seas

[57] ABSTRACT

A deformable dam made of an impermeable flexible membrane secured in a water tight manner to the bottom and side walls of a river. The flexible membrane is inflatable using either air or water, or a combination to vary the overall effective length of the dam.

7 Claims, 10 Drawing Figures

COLLAPSABLE DAM

BACKGROUND OF THE INVENTION

This invention relates to a flexible dam or weir. A prior art weir comprising an impermeable flexible membrane which is used in a river is shown in FIGS. 1–5. A body 1 is formed by a water-impermeable and flexible sheet, such as a rubber coated cloth. The body 1 is water-tightly secured at peripheral edges 5, 6 and 7 thereof to concrete bases 2, 3 and 4 which are formed on the bottom and both side banks of the river. Fluid such as water and air is introduced through inlet port 8 into the body 1 to thereby inflate the body 1 and form a dam or weir. In normal conditions, the water in the river is dammed up to a predetermined level depending on dam height and the excess water will flow thereover as shown in FIG. 2.

In higher level conditions of the river where the water greatly exceeds the height of the dam, the fluid within the body 1 is removed using port 8 to thereby empty and collapse the body 1 as shown in FIG. 3. The water then freely runs over the collapsed body 1. In this manner a collapsible dam is used.

In a situation where an alluvial formation exists (such as a delta) on the downstream side of the dam, for example, in an estuary as shown in FIG. 4, in case of a flood, the alluvial formation is eroded by the river water falling from the dam. However, in such a prior art type of dam, the erosive action of the river water against the alluvial formation downstream of the dam 9 may not be sufficient due to the dissapative effects of the dam action. As a result, the formation tends to harden since water does not flow over the entire delta area. As a result, a hardness may exist in the alluvial formation and viscosity in flow conditions of the alluvial formation is increased. During flood conditions substantial eroding will take place and when the dam is collapsed, it tends to fall on the remaining alluvial formation as shown in FIG. 5. This leads to the disadvantage that the cross section of the river is reduced to the dimension corresponding to a height H of the remaining alluvial material 12.

SUMMARY OF THE INVENTION

Accordingly, in view of the above noted defects, an object of the present invention is to provide a flexible dam having at least one hollow bag made of impermeable material, the bag being charged or discharged with fluid to thereby vary the circumference.

Various modifications of the hollow bag are considered to be within the scope of this invention. For example, a plurality of cylindrical units are made of impermeable flexible membranes. The cylindrical units are sealingly connected one by one in the diametric direction. The connected cylindrical unit body is watertightly secured to the bed and the side banks of the river to thereby form a flexible dam.

DESCRIPTION OF THE PREFERRED EMBODIMENT

Figure 1:
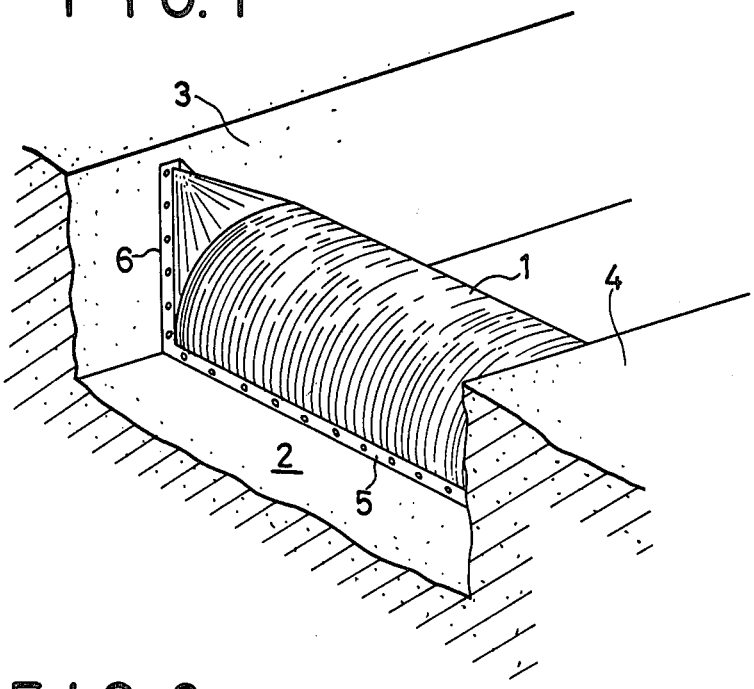
FIG. 1 shows a perspective view of a prior art flexible dam made of an impermeable membrane.
Figure 2:
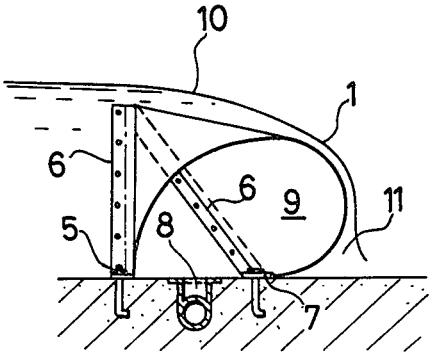
FIG. 2 shows a cross section of the flexible dam being inflated with fluid, shown in FIG. 1.
Figure 3:
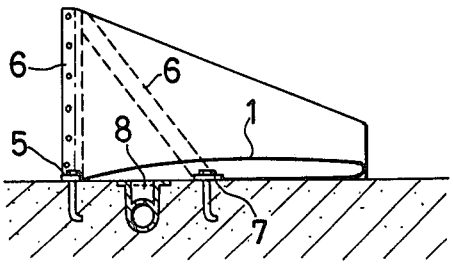
FIG. 3 shows a cross section of the flexible dam shown in FIG. 1 in the collapsed state.
Figure 4:
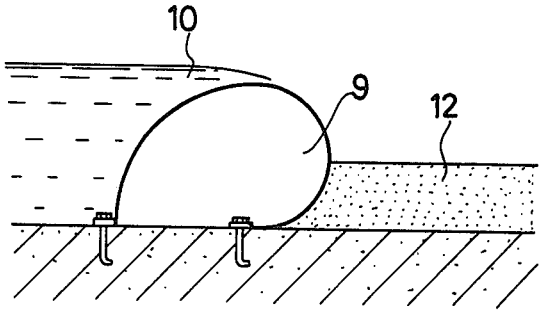
FIG. 4 shows a cross section of the inflated flexible dam in FIG. 1, having an alluvial formation downstream.
Figure 5:
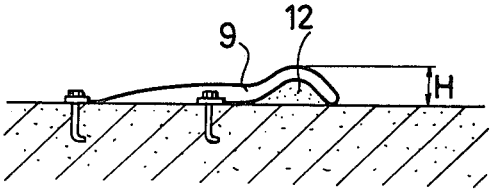
FIG. 5 shows a cross section of a collapsed flexible dam in FIG. 1, having a remaining alluvial formation downstream.
Figure 6A:
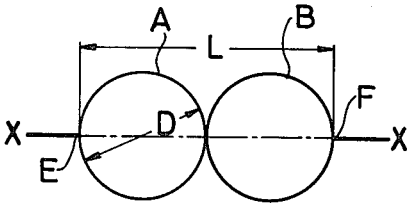
FIGS. 6(*a*) and 6(*b*) are schematic illustrations of the present invention.
Figure 6B:
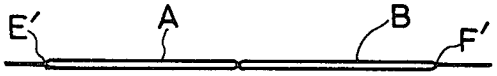

A flexible dam will now be described in detail with reference to the accompanying drawings. In this embodiment, the plurality of cylindrical units are hollow bags. FIGS. 6(*a*) and 6(*b*) schematically show an essential aspect of the present invention. In FIG. 6(*a*), A and B designate cylindrical units having the same diameter D, respectively. The units are made from an impermeable flexible membrane. FIG. 6(*a*) also shows a cross section of the connection of the units which are inflated with gas to have circular cross sections. A relation of $L=2D$ is established, where L is the length from an outer end E to the other outer end F on the center line XX. FIG. 6(*b*) shows the state of the cylindrical units when the gas is fully exhausted and the units are collapsed in a flat state. A relation of $\pi D/2\times 2=\pi D=1.5L$ is established. Therefore, when the collapsed cylindrical units are inflated with gas, the length EF is shorter than the length E'F'. This concept is effectively utilized in the present invention.

Figure 7A:
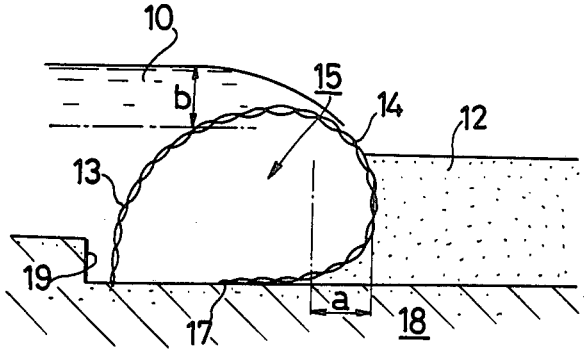
FIGS. 7(*a*) and 7(*b*) are cross sections of a flexible dam showing the operation of the present invention.
Figure 7B:
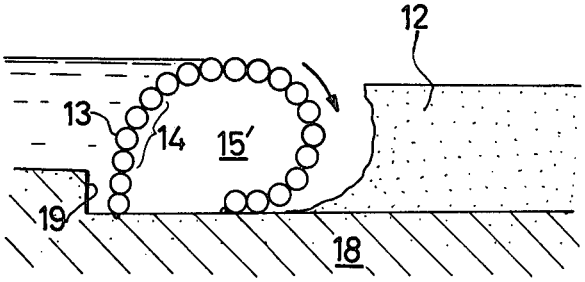

FIG. 7(*a*) shows a cross section of a preferred embodiment. Reference numeral 13 designates one of cylindrical bags made of an impermeable flexible membrane, such as a rubber coated sheet, having a gas charge/discharge port (not shown). Reference numeral 14 designates a connecting body for sealingly connecting a plurality of unit cylindrical bodies 13 in the diametrical direction. The dam body 15 comprises the connected unit body 14. End portions of the cylindrical units 16 and 17 are water-tightly secured to a concrete base 18 which is formed on the river floor. Both sides of the connected unit body are also water-tightly secured to the side banks (not shown). The base 18 has a recess 19 portion to be used for receiving the folded dam in a collapsed condition.

As shown in FIG. 7(*b*), in operation, air is introduced into the cylindrical units 13. Accordingly, the effective length of the dam decreases. When the enveloped region defined by the flattened connected body is supplied with fluid to inflate it to form a dam 15', the overall length of the connected body is shortened as shown in FIG. 7(*b*). A dam 15' which is formed by the shortened connected body advances by a distance a in the upstream direction. That is, as shown in FIG. 7(*a*) the connected body 14 moves to the left a distance a and the effective height is reduced. Accordingly, a volume of the water corresponding to height differential (*b*) overflows the dam 15' formed by the reduced body. Therefore, any accumulated alluvial formation 12 will be flushed with the flood water to be removed from the river bottom. This maintains the effective height of the dam.

Figure 8:
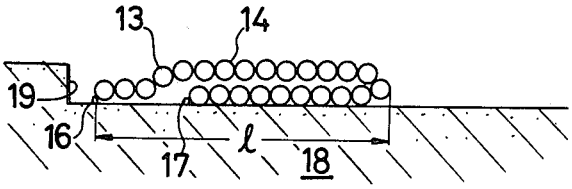
FIG. 8 is a cross section of the flexible dam in the collapsed condition according to the present invention.

FIG. 8 shows connected body 14 collapsed on the concrete base from which the alluvial formation has been completely removed by the flood water flush. In this condition, if the concrete base on which the connected body is mounted is reduced the thickness by means of the recess thereof, the cross section of the river will be reduced. It is also possible to retract the collapsed connected body into the space designated by l in FIG. 8. In this connection, the body 14 is substantially flush in recess 19 with the top river bed concrete base 18.

A cylindrical unit body is used substantially at right angles to the flow direction of the river. This will of course create uniform damming action. However, due to topology problems the dam may in some conditions be angled with respect to the flow direction.

The invention is not limited to the embodiment wherein the cylindrical units are predeterminedly formed and thereafter connected to each other as described above. To obtain the same effect, it is possible to substitute laterally connected spheres for the cylindrical bodies.

Such hollow bags can also be formed, for example, using corrugating pairs of impermeable flexible membranes and coupling them to coincide the convex portions formed on one membrane with those on the other. In this case, convex portions of the two membranes may be connected to each other. Many modifications may be also considered. However, the essence of the invention resides in that the fact that the hollow bags are provided using an impermeable flexible membrane and are supplied with fluid thereinto to thereby reduce the overall circumference of the dam by inflation of the bags.

The present invention therefore relates to a deformable dam made of an impermeable flexible membrane, wherein the inside of the dam is charged and discharged with fluid and as the hollow bags are charged or discharged with fluid to thereby vary the circumference of the dam. The accumulated alluvial formation is flushed away by the water overflowing the dam which is advanced in the upstream direction according to the invention. In a flood in the upstream region, when the dam is collapsed, the cross section of the river is therefore not reduced.

Other modifications of the invention are possible without departing from the essential scope of this invention.

We claim:

1. In a deformable dam having an impermeable flexible membrane wall which is water-tightly secured to the bottom and side walls of a river, the improvement comprising: said impermeable flexible membrane wall including at least one hollow bag forming a part of said wall, and means for selective charging and discharging the hollow bag with a fluid to thereby vary the effective height and length of said dam and prevent the accumulation of alluvial material under said flexible membrane by having the alluvial material removed by the flow of water over the dam.

2. The deformable dam of claim 1 wherein said flexible membrane comprises a plurality of hollow cylindrical bodies, said bodies being coupled to each other.

3. The deformable dam of claim 1 wherein said flexible membrane comprises a plurality of hollow convex wall shaped bodies, said convex bodies being coupled to each other at the edge juncture of each convex wall.

4. The deformable dam of claims 1, 2 or 3 wherein said flexible membrane comprises a rubber coated sheet.

5. The deformable dam of claim 1 further comprising a solid base disposed on the bottom of said river, said base having a recess portion, said membrane being secured to said base in the recess portion thereof.

6. The deformable dam of claim 1 wherein said charging fluid is air.

7. The deformable dam of claim 1 wherein said flexible membrane comprises a plurality of hollow spheres, said spheres laterally joined together.

* * * * *